United States Patent [19]

Bagnall et al.

[11] Patent Number: 4,542,785

[45] Date of Patent: Sep. 24, 1985

[54] AGRICULTURAL HARVESTER HEAT EXCHANGER

[75] Inventors: Ralph S. Bagnall, Mississauga; William N. Helm, Oakville, both of Canada

[73] Assignee: Massey-Ferguson Industries Limited, Ontario, Canada

[21] Appl. No.: 534,907

[22] Filed: Sep. 23, 1983

[51] Int. Cl.[4] ..... F28G 3/16

[52] U.S. Cl. ..... 165/95; 55/294; 55/385 B; 55/493; 165/41; 165/119

[58] Field of Search ..... 165/95, 97, 119, 41; 55/269, 294, 385 B, 493; 180/68 R

[56] References Cited

U.S. PATENT DOCUMENTS

| | | | |
|---|---|---|---|
| 3,377,780 | 4/1968 | Noland | 55/294 |
| 3,504,482 | 4/1970 | Goettl | 55/493 X |
| 3,837,149 | 9/1974 | West et al. | 55/385 B X |
| 4,036,613 | 7/1977 | Brown et al. | 55/294 |
| 4,233,040 | 11/1980 | Vogelaar et al. | 55/385 B X |
| 4,338,104 | 7/1982 | Merry | 55/294 X |
| 4,439,218 | 3/1984 | Priepke et al. | 55/385 B X |
| 4,443,236 | 4/1984 | Peiler | 55/294 X |

FOREIGN PATENT DOCUMENTS

| | | | |
|---|---|---|---|
| 1155 | of 1906 | United Kingdom | 55/294 |

*Primary Examiner*—Sheldon J. Richter

*Assistant Examiner*—Randolph A. Smith

*Attorney, Agent, or Firm*—Robert L. Farris

[57] ABSTRACT

The agricultural harvester 10 cooling system includes a heat exchanger 38 for cooling an internal combustion engine 32 and a heat exchanger air cleaner assembly 36. The heat exchanger air cleaner assembly has a fixed screen 62 adjacent the heat exchanger 32 which forms one wall of a large box 45. Channel members 64 and 66 and flat bars 68 hold the fixed screen 62 in a plane and form a plurality of pie-shaped compartments. The air cutoff plate 78 on rotatable shaft 72 closes the pie-shaped compartments and substantially blocks the flow of air through the fixed screen 62. A suction pipe 84 adjacent the fixed screen 62 and inside the large box 45 rotates with the rotatable shaft 72 directly across the fixed screen from the cutoff plate 78. The suction pipe 84 is connected to the intake of a centrifugal blower 118 by a vacuum pipe 96. The centrifugal blower 118 sucks trash from the fixed screen 62 and through a long slot 88 in the suction pipe 84 as the suction pipe 84 is moved along the surface of the fixed screen 62 by the rotatable shaft 72. The large box has a fixed air inlet screen 60 in the top wall 56. Hinge 58 which connects the large box 45 to the support frame 40 allows the fixed screen 62 to be pivoted away from the heat exchanger 38 for service. An oil cooler 108 is positioned between the fixed screen 62 and the heat exchanger 38 and is also connected to the support frame 40 by the hinge 58.

7 Claims, 11 Drawing Figures

FIG. 7.
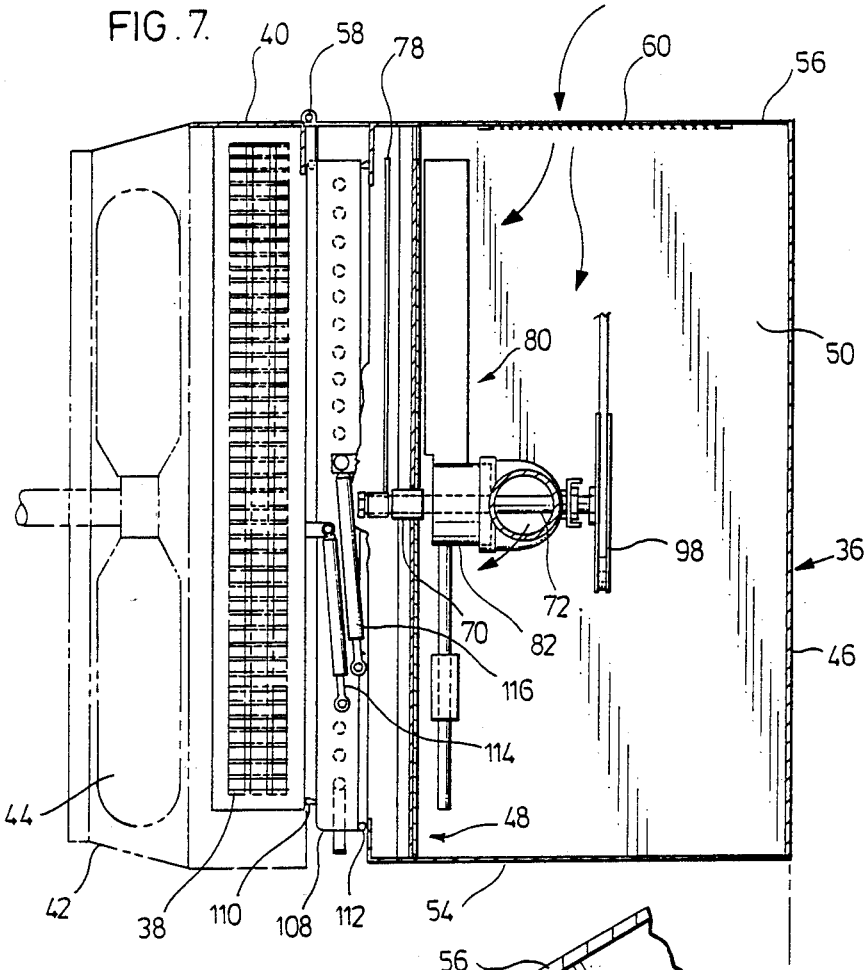
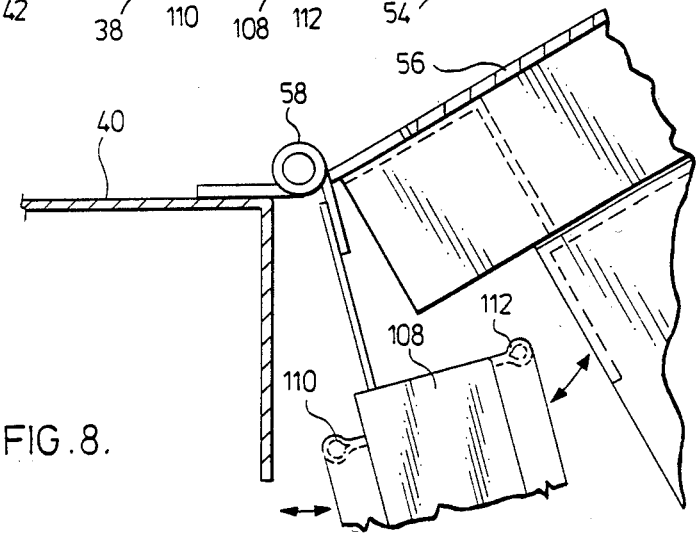
FIG. 8.

AGRICULTURAL HARVESTER HEAT EXCHANGER

TECHNICAL FIELD

The invention relates to heat exchangers on agricultural harvesters. These exchangers cool an internal combustion engine, hydraulic oil and air conditioners. The heat exchangers are cooled by air. Crop material is removed from the air before the air passes through the heat exchangers to prevent plugging of the heat exchangers.

BACKGROUND ART

Early agricultural harvesters had only an internal combustion engine to cool. To keep the radiator from plugging, an air inlet duct with a screen covered inlet opening was mounted on one side of the radiator. In crop conditions with a large quantity of light fluffy crop material, the fixed screen would become plugged. These screens were cleaned manually with the internal combustion engine stopped.

Most agricultural harvesters currently manufactured have a screen which rotates. Many of these screens rotate at a relatively high speed and rely on centrifugal force to throw crop material off the screen surface. With these screens, the crop material can slide along the surface of the screen and eventually wear away the metal. Some crop material is so light that it is not removed by centrifugal force. This light material will plug rotating screens. Rotating screens have been modified by the addition of baffles to block the passage of air or by the addition of suckers to suck light material off the screen.

Cyclone separators have also been tried to remove trash from air before the air passes through heat exchangers. Cyclone separators work well in most conditions. However, when there is a substantial amount of very light material that cannot be separated by centrifugal force in the cyclone separator, the heat exchangers can plug.

There is a substantial air pressure drop with both rotating screens and with cyclone separators. To overcome the pressure drop it is necessary to use a relatively large fan or increased fan speed to move air through the screen and the heat exchanger. The relatively large fan or the increased fan speed requires additional power.

DISCLOSURE OF INVENTION

The invention includes a heat exchanger for cooling an internal combustion engine and a fixed screen adjacent one side of the heat exchanger and forming a side wall of an air inlet box. The box has a top wall with large air inlet apertures. The fixed screen, which is adjacent one side of the heat exchanger, includes several stiffener members secured to the side of the screen facing the heat exchanger, which stiffen the screen and form open compartments. An air cutoff member is capable of closing each open compartment formed by the stiffener members as the rotatable shaft rotates. A suction device is mounted on the rotatable shaft on the opposite side of the fixed screen from the air cutoff plate. A centrifugal blower inlet is connected to the suction device so that it sucks light material from the fixed screen as the rotatable shaft rotates. Drive means are provided to drive the rotatable shaft. A fan is provided on the side of the heat exchanger opposite the fixed screen to pull air through the top wall of the air inlet box, through the fixed screen and through the heat exchanger.

A hydraulic oil cooler and/or air conditioning condenser may be mounted between the heat exchanger, for cooling the internal combustion engine, and the fixed screen if desired.

The air inlet box with the fixed screen forming part of one wall is pivotally attached to the harvester. The box can be pivoted away from the heat exchangers to allow inspection and cleaning of the heat exchanger.

BRIEF DESCRIPTION OF DRAWING

FIG. 7 is a rear elevation with parts broken away of the heat exchanger of FIG. 4;

FIG. 8 is an enlarged view of the hinge connection for the oil cooler, the air inlet box and the frame;

BEST MODE FOR CARRYING OUT THE INVENTION

Figure 1:
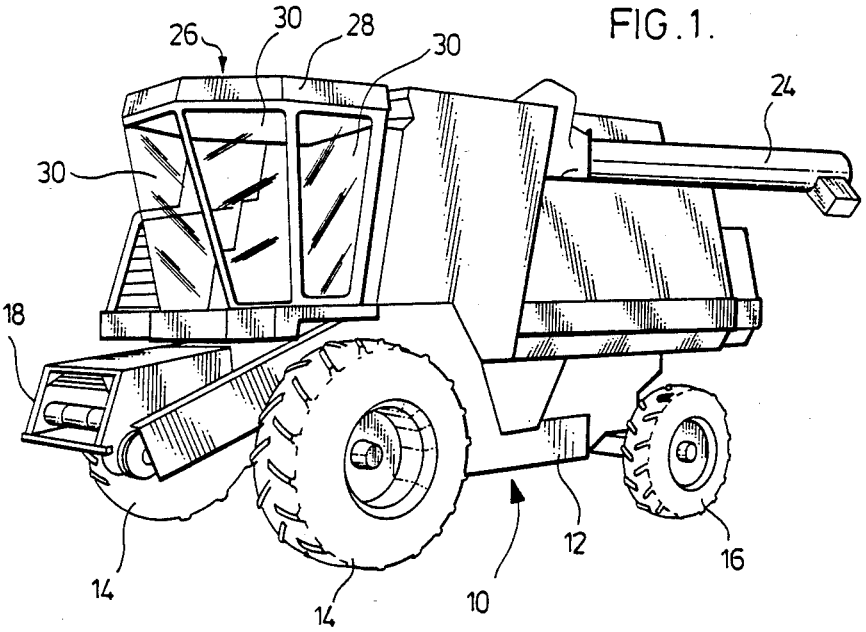
FIG. 1 is a perspective view of the front and left-hand side of a combine harvester with the crop gathering table removed.
Figure 2:
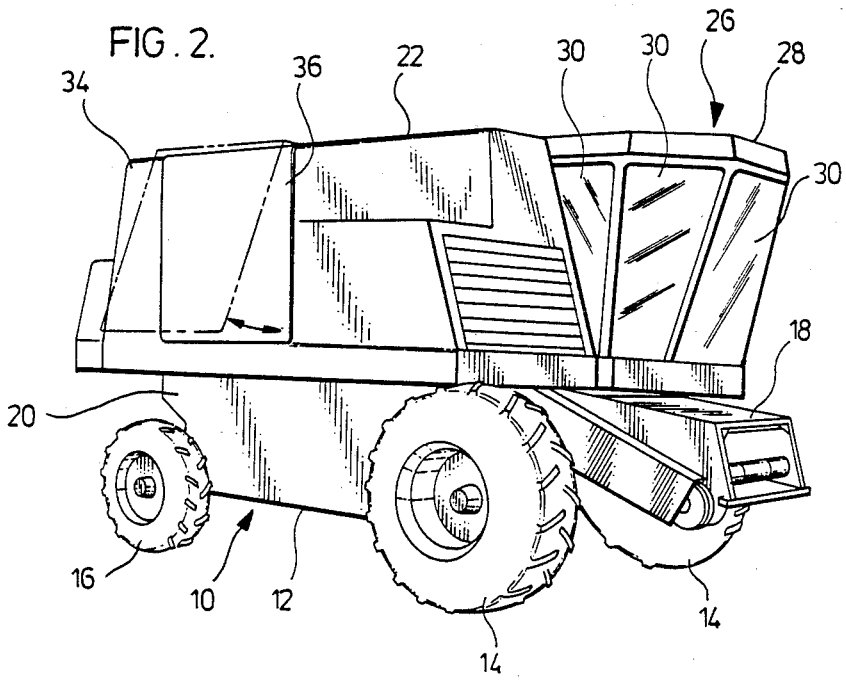
FIG. 2 is a perspective view of the front and right-hand side of a combine harvester with the crop gathering table removed and employing the heat exchanger of the invention.

The agricultural combine harvester 10 as shown in FIGS. 1 and 2 includes a frame 12 supported on a pair of front drive wheels 14 and a pair of steered rear wheels 16. An elevator 18 is pivotally mounted on the forward portion of the frame 12. Various harvesting headers (not shown) may be attached to the front portion of the elevator 18. The headers include grain tables for standing crops, pick-up tables for crops in windrows and corn heads for maize. A threshing and cleaning components housing 20 is mounted on the frame 12 for threshing and cleaning grain received from the elevator 18. A grain tank 22 is mounted on the forward portion of the frame 12 and generally above the threshing and cleaning components housing 20. An unloading conveyor system 24 for removing grain from the grain tank 22 is on the left-hand side of the combine harvester 10. An operator's cab 26 with a top 28 and windows 30 is mounted on the frame 12 in front of the grain tank 22.

Figure 3:
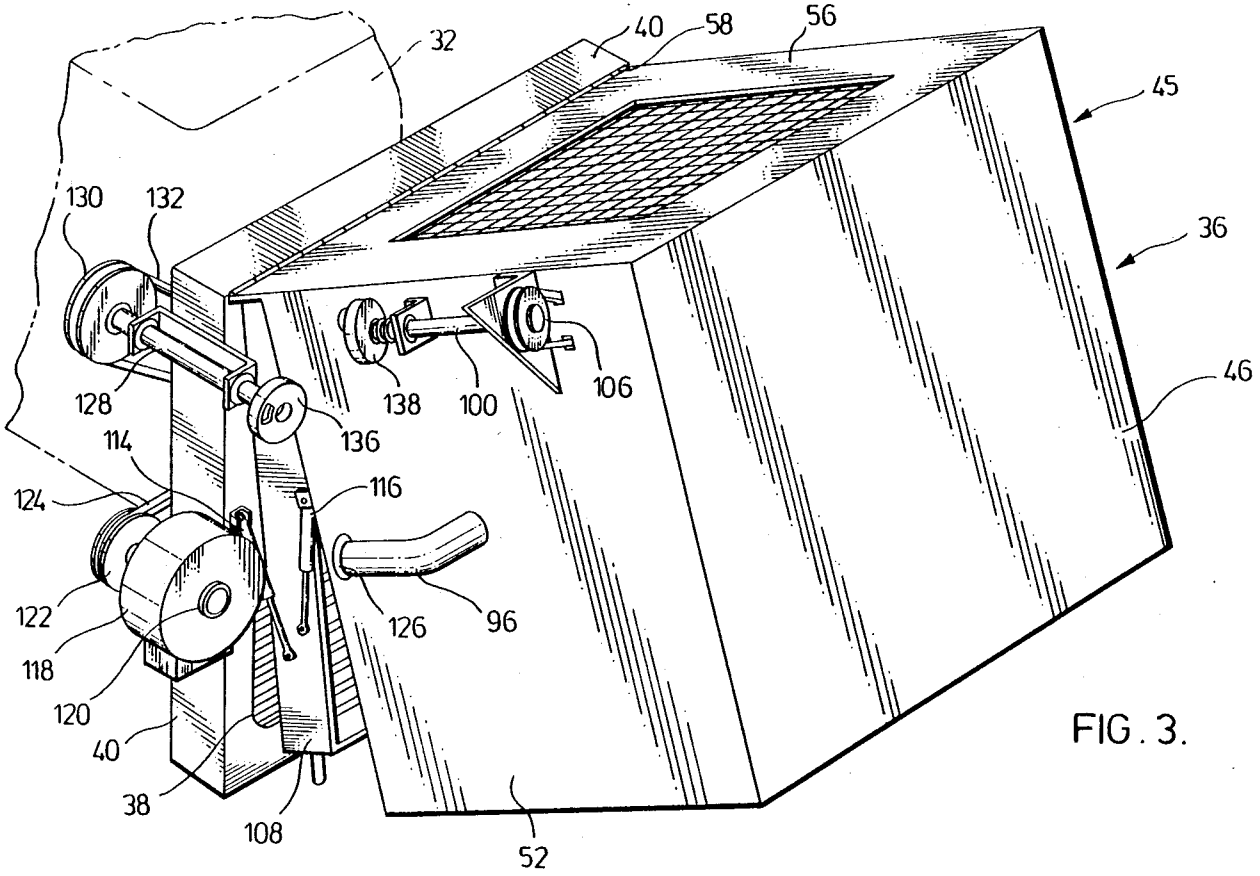
FIG. 3 is an enlarged perspective view of the harvester heat exchanger and air cleaner.
Figure 4:
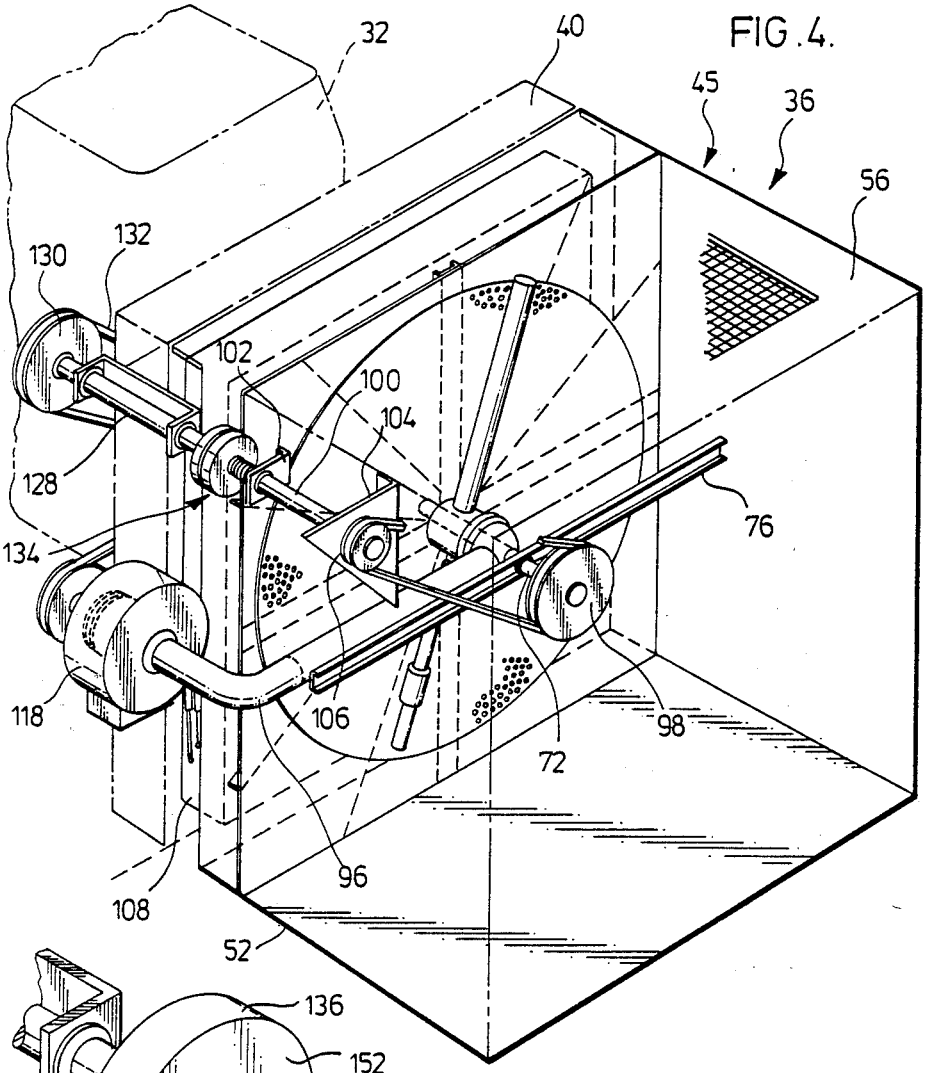
FIG. 4 is a perspective view of the heat exchanger of FIG. 3 with parts broken away and with the fixed screen in the working position.

An internal combustion engine 32 partially shown in phantom lines in FIGS. 3 and 4 is mounted in an engine compartment 34 at the rear of the grain tank 22. At least a portion of the right-hand side of the engine compartment 34 is a heat exchanger air cleaner assembly 36.

A heat exchanger 38 is mounted in a support frame 40. The support frame 40 is secured to the frame 12. A fan shroud 42 is attached to the support frame 40 on the side of the heat exchanger 38 adjacent the internal combustion engine 32. A cooling fan 44 is rotatably supported on the internal combustion engihe 32 and inside the fan shroud 42. The cooling fan 44 is driven by the internal combustion engine 32 to pull air through the heat exchanger 38 and move it toward the internal combustion engine 32.

The heat exchanger air cleaner assembly 36 includes a large box 45 with a pair of side walls 46 and 48, a front wall 50, a rear wall 52, a bottom wall 54, and a top wall 56. The large box 45 is pivotally connected to support frame 40 by a hinge 58. The top wall 56 of the large box 45 includes a fixed air inlet screen 60. This fixed air inlet screen 60 has large apertures about two inches square which prevent the entry of large material into the large box 45. The screen 60 also keeps an operator from falling into the large box 45 when servicing the harvester 10. Due to location of the large box 45 high on one side of the agricultural combine harvester 10, very little crop material reaches the fixed air inlet screen 60 which cannot pass through the apertures.

The side wall 48 of the large box 45 nearest the heat exchanger 38 includes a fixed screen 62 with small apertures. This fixed screen 62 separates all material from the air which will not freely pass through the heat exchanger 38. Channel members 64 and 66 are secured to the side of the fixed screen 62 adjacent the heat exchanger 38. Several flat bars 68 are secured to the channel members 64 and 66 and to the fixed screen 62. The flat bars 68 together with the channel members 64 and 66 and the fixed screen 62 form several generally pie-shaped chambers with an opening facing the heat exchanger 38.

A bearing member 70 is secured to the channel members 64 and 66 in the center of the fixed screen 62. A rotatable shaft 72 is rotatably journaled in the bearing member 70. The rotatable shaft 72 also passes through a bearing 74 mounted on bearing support 76 inside the large box 45. An air cutoff plate 78 is secured to the rotatable shaft 72 outside the large box 45 and adjacent the channel members 64 and 66 and the flat bars 68. The air cutoff plate 78 rotates with the rotatable shaft 72 closing and unclosing the generally pie-shaped chambers. When a pieshaped chamber is closed, the flow of air through that section of the fixed screen 62 is substantially blocked.

A suction device 80 is secured to the rotatable shaft 72 inside the large box 45. The suction device 80 includes a central chamber 82, a suction pipe 84 extending outwardly from one side of the central chamber 82 and a counter weight assembly 86 extending outwardly from the other side of the central chamber 82. The suction pipe 84 has a long slot 88 in one side adjacent the fixed screen 62. The outer free end of the suction pipe 84 is covered by a cap 89.

The central chamber 82 of the suction device 80 is connected to a stationary vacuum chamber 90. The vacuum chamber 90 is secured to the bearing support 76 inside the large box 45. A seal 92 limits the passage of air through the connection between the rotatable central chamber 82 and the stationary vacuum chamber 90. A second seal 94 limits the passage of air into the vacuum chamber 90 through the aperture for the rotatable shaft 72. A vacuum pipe 96 is connected to the vacuum chamber 90 and extends out through the rear wall 52 of the large box 45.

A V-belt pulley 98 is mounted on the free end of the rotatable shaft 72 inside the large box 45. A drive shaft 100 is journaled in brackets 102 and 104 connected to the outer surface of the rear wall 52 of the large box 45. A V-belt pulley 106 is secured to one end of the drive shaft 100. A V-belt for driving the rotatable shaft 72 is trained around the V-belt pulleys 98 and 106 and passes through the rear wall 52 of the large box 45.

An oil cooler 108 is pivotally attached to the support frame 40 by a hinge 58. This hinge 58 shown in FIG. 8 is the same hinge that connects the large box 45 to the support frame 40. The oil cooler 108 is positioned between the heat exchanger 38 and the side wall 48 of the large box 45. Seals 110 and 112 of resilient material are provided on the oil cooler 108. These seals 110 and 112 insure that all the air, pulled through the heat exchanger 38 and the oil cooler 108, passes through the fixed screen 62. The oil cooler 108 could be a combination oil cooler and separate air conditioner condenser, if desired.

The hinge 58 as shown in the drawing is positioned horizontally at the top of the support frame 40, the big box 45 and the oil cooler 108. The hinge 58 could, if desired, also be vertical. At least one first gas cylinder 114 is pivotally secured to the support frame 40 and the oil cooler 108. Another gas cylinder 116 is pivotally secured to the oil cooler 108 and the large box 45. These gas cylinders 114 and 116 pivot the large box 45 and the oil cooler 108 about the axis of the hinge 58 and away from the heat exchanger 38. This provides access to the heat exchanger 38, both sides of the oil cooler 108 and the fixed screen 62 for cleaning and maintenance. A latch (not shown) may be provided to lock the oil cooler 108 and the large box 45 in the normal operating position shown in FIGS. 4 and 7.

A centrifugal blower 118 is attached to the support frame 40. The centrifugal blower 118 has an air intake surrounded by a ring 120 shown in FIG. 3 and an input pulley 122. A V-belt 124 trained around the input pulley 122 and a pulley (not shown) on the crankshaft of the internal combustion engine 32, drives the centrifugal blower 118. A flange 126 on the vacuum pipe 96 includes a flexible seal member that abuts the ring 120 and thereby connects the centrifugal blower 118 inlet to the suction device 80 when the large box 45 is in the operating position as shown in FIGS. 4 and 7.

The drive shaft 100 journaled on the rear wall 52 of the large box 45 is driven by a shaft 128 rotatably journaled on the support frame 40. An input pulley 130 mounted on one end of the shaft 128 is driven by a V-belt 132 trained around a drive pulley (not shown) on the drive shaft for the cooling fan 44.

Figure 5:
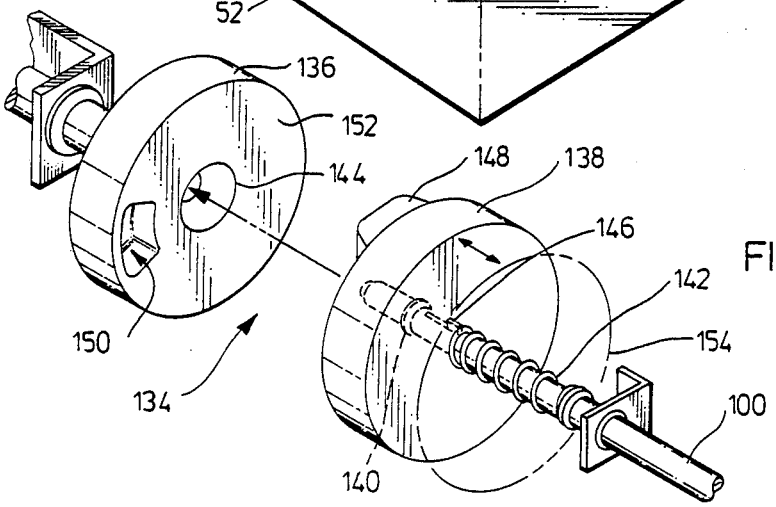
FIG. 5 is an enlarged perspective view of a portion of the suction device and air cutoff plate drive shown in FIG. 4.
Figure 6:
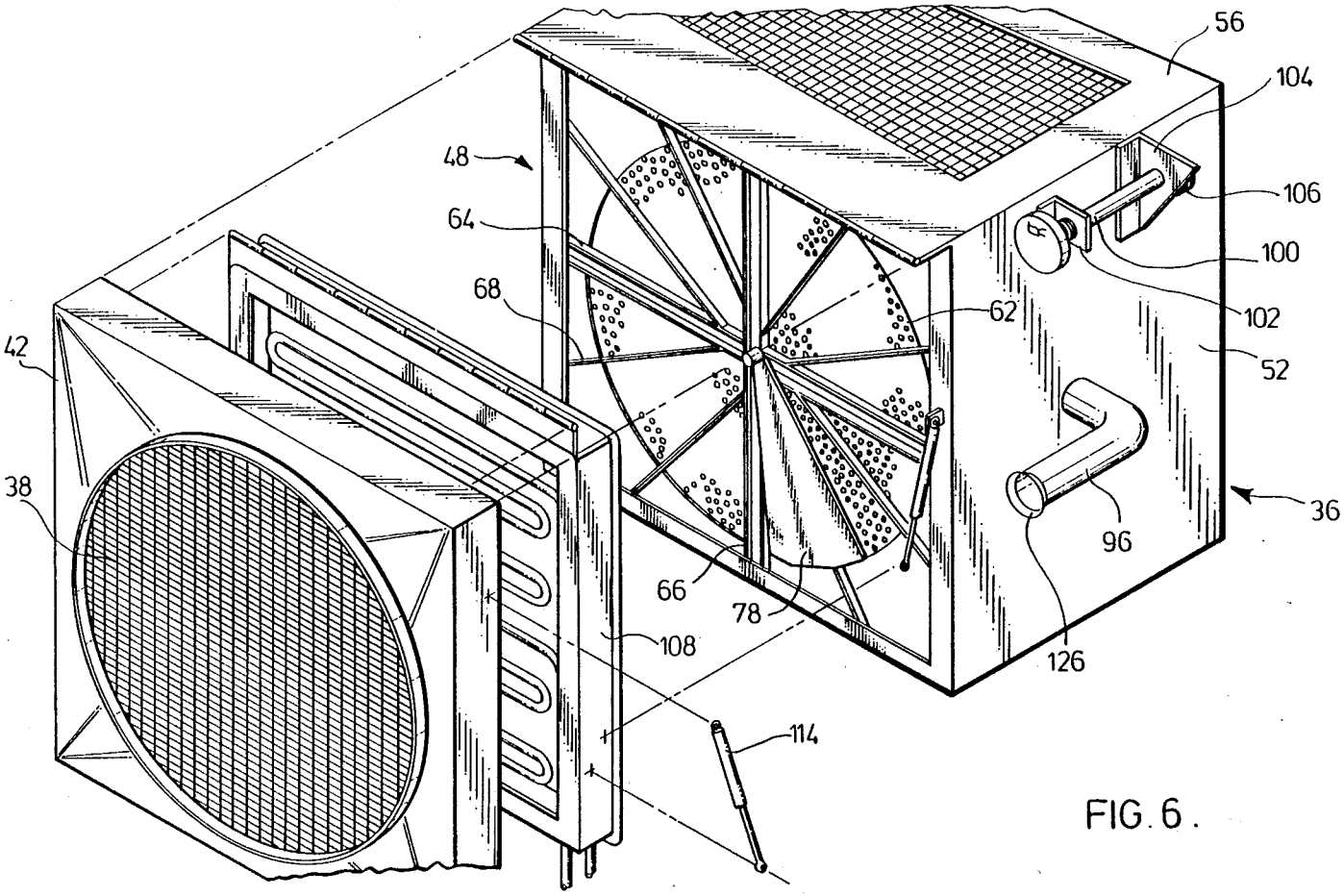
FIG. 6 is an exploded perspective view of the heat exchangers of FIG. 4 and the downstream side of the fixed screen.
Figure 9:
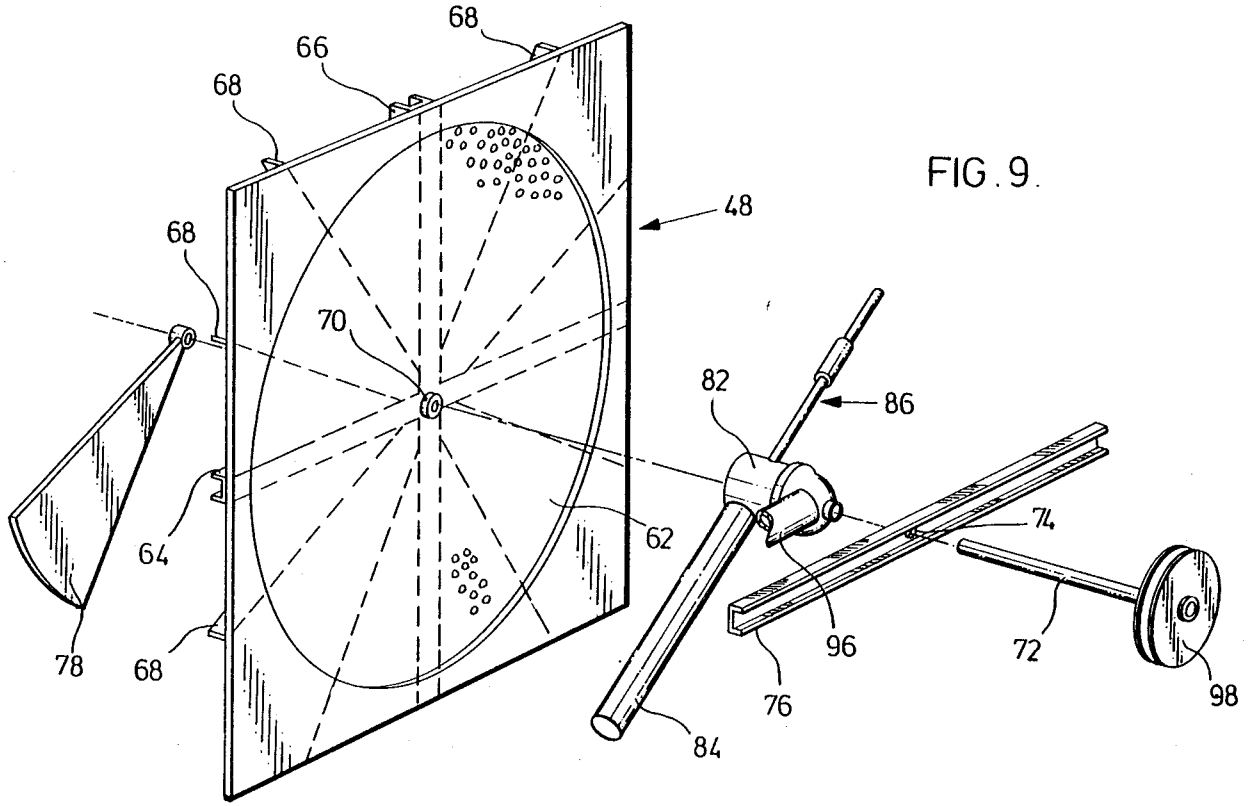
FIG. 9 is an exploded perspective view of the fixed screen, the air cutoff plate, the suction device and the support shaft.
Figure 10:
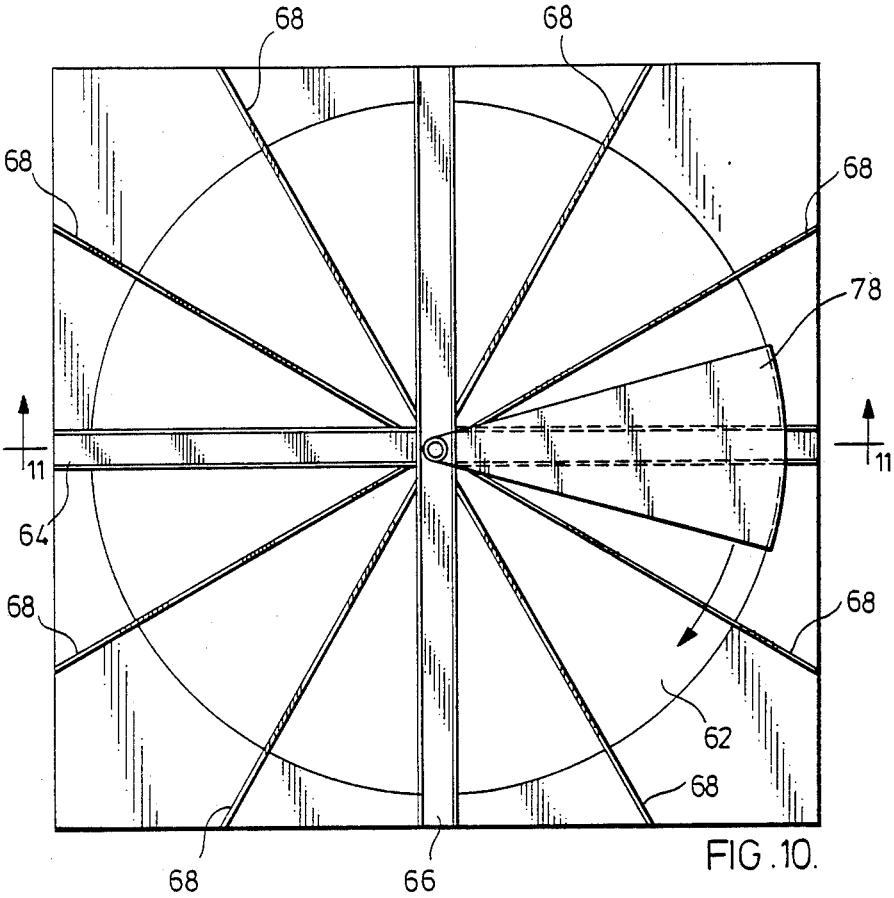
FIG. 10 is a side elevation of the downstream side of the fixed screen and the air cutoff plate shown in FIG. 9.
Figure 11:
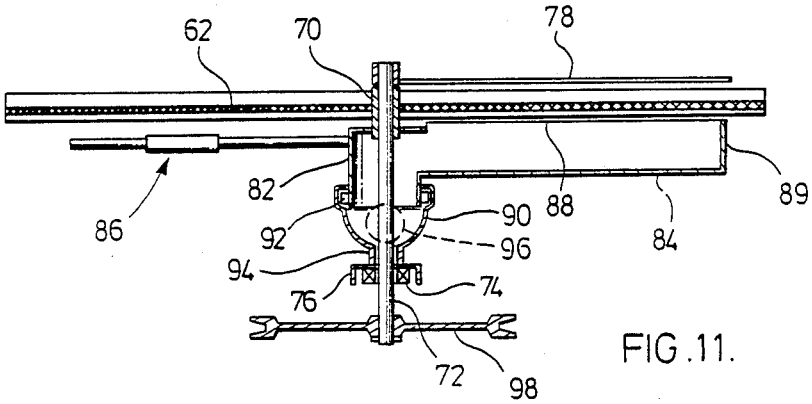
FIG. 11 is a sectional view taken along lines 11—11 of FIG. 10.

The shaft 128 drives the drive shaft 100 through an automatic shaft coupler 134 shown in FIG. 5. The automatic shaft coupler 134 includes a first disc 136 fixed to the shaft 128 and a second disc 138 slideably retained on drive shaft 100 by retainer 140. A spring 142 biases the second disc 138 along the drive shaft 100 and toward the retainer 140. An end of the drive shaft 100 is receivable in a conical recess 144 in the first disc 136 to align the drive shaft 100 with the shaft 128. A key 146 prevents rotation between the second disc 138 and the drive shaft 100. A lug 148 on the second disc 138 is receivable in an aperture 150 in the first disc 136. When the lug 148 is within the aperture 150 the shaft 128 can drive the drive shaft 100. When the large box 45 is pivoted about the axis of the hinge 58 to the inoperative position shown in FIGS. 3 and 8, the lug 148 and the drive shaft 100 disengage from the aperture 150 and the conical recess 144. When the large box 45 is pivoted back to the working position, the drive shaft 100 enters the conical recess 144 and the lug 148 either enters the aperture 150 or contacts the surface 152 of the first disc 136. If the lug 148 contacts the surface 152, the second disc 138 is slid along the drive shaft 100 to the position indicated by the broken line 154 in FIG. 5. When the shaft 128 is rotated by the internal combustion engine 32, the lug 148 slides along the surface 152 until the lug 148 is forced into the aperture 150 by the spring 142. The second disc 138 preferably includes three symetrically spaced lugs 148 and the first disc 136 preferably includes three symetrically spaced apertures 150 which can receive the three lugs 148. Only one lug 148 and one aperture 150 has been shown in the drawing for simplification.

In operation, the cooling fan 44 pulls air through the fixed air inlet screen 60 and into the large box 45 of the heat exchanger air cleaner assembly 36. Air is pulled from large box 45 through the fixed screen 62, through the oil cooler 108 and finally through the heat exchanger 38 and into the engine compartment 34 by the cooling fan 44. Any material in the air inside the large box 45 which cannot freely pass through the oil cooler 108 and the heat exchanger 38 is held on the surface of the fixed screen 62 by the moving air. The material held on the surface of the fixed screen 62 is removed by the combined action of the air cutoff plate 78 and the suction device 80. As the rotatable shaft 72 is rotated, the air cutoff plate 78 substantially blocks the flow of air through the fixed screen 62 of the pie-shaped section which is covered. Blocking the flow of air substantially reduces the force holding material on the surface of the fixed screen 62. The suction pipe 84 which is on the upstream side of the fixed screen 62 directly opposite the air cutoff plate 78 sucks material off the fixed screen 62. This material enters the suction pipe 84 through the long slot 88, passes through the vacuum pipe 96, into the air intake of the centrifugal blower 118 and is then discharged from the agricultural combine harvester 10. The rotatable shaft 72 is driven by the internal combustion engine 32 so that the suction device 80 in combination with the air cutoff plate 78 cleans the entire fixed screen 62 periodically.

The channel members 64 and 66 together with the flat bars 68 hold the fixed screen 62 substantially in a plane so that the suction pipe 84 can remain very close to the upstream side of the fixed screen 62 as the rotatable shaft 72 turns. The channel members 64 and 66 together with the flat bars 68 have downstream edges substantially in a common plane to cooperate with the air cutoff plate 78 to block the flow of air through the fixed screen 62. This substantially improves the cleaning efficiency of the suction device 80.

The fixed screen 62 allows relatively free passage of air. This allows the cooling fan 44 to move an adequate volume of air through the fixed screen 62 with less power consumption than is required with prior art rotating screens or cyclone separators.

What is claimed is:

1. An agricultural harvester cooling system for cooling an internal combustion engine including a support frame, a heat exchanger mounted on the support frame, a cooling fan for moving air through the heat exchanger, a drive for the cooling fan, and a heat exchanger air cleaner assembly characterized by a fixed screen mounted on the support frame adjacent one side of the heat exchanger, a rotatable shaft passing through the fixed screen, at least one bearing assembly supporting the rotatable shaft, an air cutoff plate secured to the rotatable shaft between the fixed screen and the heat exchanger, a suction device including a central chamber secured to the rotatable shaft, a suction pipe attached to the central chamber and extending radially outward from the rotatable shaft directly opposite the air cutoff plate with the fixed screen between the suction pipe and the air cutoff plate, a long slot in the side of the suction pipe adjacent the fixed screen, a vacuum source mounted on the support frame, a vacuum pipe connected to the vacuum source and the central chamber of the suction device and a drive connected to the rotatable shaft.

2. An agricultural harvester cooling system as set forth in claim 1 characterized by the fixed screen being pivotally attached to the support frame.

3. An agricultural harvester cooling system as set forth in claim 2 characterized by the drive for the rotatable shaft and the attached air cutoff plate and the suction pipe including an automatic shaft coupler.

4. An agricultural harvester cooling system as set forth in claim 1 characterized by the fixed screen being a portion of one wall of a large box and a portion of another wall of the large box including an opening for the movement of air into the large box.

5. An agricultural harvester cooling system as set forth in claim 1 characterized by an oil cooler pivotally mounted on the support frame and positioned between the heat exchanger and the fixed screen, by a seal between the heat exchanger and the oil cooler and by a seal between the oil cooler and the fixed screen.

6. An agricultural harvester cooling system as set forth in claim 1 characterized by the vacuum source including a blower and by the vacuum pipe being connected to the blower inlet.

7. An agricultural harvester cooling system as set forth in claim 1 characterized by the fixed screen including bar members on the side adjacent the fixed screen facing the heat exchanger which hold the fixed screen flat and which cooperate with the air cutoff plate to block the flow of air through the fixed screen.

* * * * *